United States Patent [19]

Ring Jr.

[11] 4,177,970

[45] Dec. 11, 1979

[54] VALVE ASSEMBLY FOR USE IN AN AIR DISTRIBUTION SYSTEM

[75] Inventor: Harry K. Ring Jr., La Crosse, Wis.

[73] Assignee: The Trane Company, La Crosse, Wis.

[21] Appl. No.: 905,311

[22] Filed: May 12, 1978

[51] Int. Cl.[2] ..... F16K 31/126

[52] U.S. Cl. ..... 251/61.3; 236/49; 251/282

[58] Field of Search ..... 137/219, 625.38, 625.37; 236/49; 251/61.3, 61.4, 282

[56] References Cited

U.S. PATENT DOCUMENTS

| | | | |
|---|---|---|---|
| 2,725,891 | 12/1955 | De Bourgaignon et al. | 137/219 |
| 2,970,806 | 2/1961 | Rexford et al. | 251/282 |
| 3,955,595 | 5/1976 | Modes | 236/49 |
| 3,961,748 | 6/1976 | McNabney | 137/625.38 |
| 3,974,859 | 8/1976 | McNabney | 236/49 |
| 4,082,114 | 4/1978 | Hontke et al. | 251/63.6 |

*Primary Examiner*—Martin P. Schwadron
*Assistant Examiner*—G. L. Walton
*Attorney, Agent, or Firm*—Carl M. Lewis; Peter D. Ferguson

[57] ABSTRACT

A valve assembly is disclosed for use in an air distribution system which includes a plenum chamber (*2a, b*) having an inlet opening (4) and an outlet (5). Conduit means are provided for admitting air to the plenum chamber through the inlet opening and include a generally cylindrical sleeve (6) having at least a portion thereof disposed within the plenum chamber, which portion includes aperture means (7) passing radially therethrough. A generally cylindrical valve member (9) is disposed within the sleeve and includes an axially extending portion for selectively blocking off the aforesaid aperture means. The valve member (9) is supported for axial movement between a first, closed, and a second, open position and may also be positioned at any point therebetween. Due to a slight clearance between the valve member (9) and the inner periphery of sleeve (6), a small amount of air flow is permitted to pass therebetween, whereby an axial force is imposed upon the valve member. A force balancing member (24) is provided in order to counteract this axial force by providing a restriction to the small amount of air flow, whereby a relatively low pressure area is created downstream of member (24), while a relatively high pressure area exists upstream therefrom. This pressure differential acts upon force balancing member (24) in order to counteract the axial force produced as a result of the aforesaid small amount of air flow.

6 Claims, 2 Drawing Figures

VALVE ASSEMBLY FOR USE IN AN AIR DISTRIBUTION SYSTEM

DESCRIPTION

1. Technical Field

The present invention relates to air valves for use in air distribution systems wherein the volume of conditioned air supplied to a conditioned zone is varied in order to control the temperature within the conditioned zone.

2. Background Art

U.S. Pat. No. 4,082,114; issued on Apr. 4, 1978, which patent is commonly assigned with the present application, discloses three embodiments of an air valve for use in an air distribution system. One of these embodiments, namely that illustrated in FIGS. 2 and 5 of said patent, is specially adapted for operation using the conditioned air supply itself as the actuating power source for the valve, a control arrangement generally known to those skilled in the art and termed "system-powered" operation. The present invention relates to an improvement in the system-powered air valve assembly disclosed in said patent.

DISCLOSURE OF THE INVENTION

The valve assembly of the present invention includes a plenum chamber having an inlet opening and an outlet, with conduit means provided for admitting air to the plenum chamber through said inlet opening. The conduit means includes a generally cylindrical sleeve having at least a portion disposed within the plenum chamber and including aperture means passing radially therethrough for providing communication between the interior of the sleeve and the interior of the plenum chamber. A closure member at the end portion of the sleeve downstream from the aperture means blocks axial air flow.

A generally cylindrical valve member is disposed within the sleeve and includes an axially extending portion disposed adjacent but slightly spaced from the inner periphery of the sleeve, which valve member further includes passage means for providing communiction between its axial ends to thereby substantially balance axial pressure forces to which it is subjected. Suitable mounting means are provided for supporting the valve member for axial movement between a first position substantially coextensive with the aperture means, thereby blocking flow therethrough; and a second position substantially non-coextensive with said aperture means for permitting flow therethrough. When the valve member is in positions intermediate the first and second positions, a small amount of air flow is permitted through the aforesaid passage means, between the axially extending portion of the valve member and the inner periphery of the sleeve, and through said aperture means. It has been found during tests that this small amount of air flow results in a force being imposed upon a valve member in a direction urging same towards said first position, thereby resulting in a slight imbalance in valve operation.

This imbalance represents a significant factor in a system-powered air valve of the type under consideration in that the forces available for actuation of the valve are limited to those available from the pressure of the conditioned air.

Accordingly, the present invention lies in the provision of force balancing means associated with the valve member to counteract the aforesaid axial force and imbalance; which force balancing means include means for restricting the small amount of air flow through the passage means, thereby providing a relatively low pressure area downstream of the valve member, and means connected to the valve member having a first axially projected area subjected to the relatively high pressure area upstream from the valve member and a second axially projected area subjected to the relatively low pressure area downstream from the valve member.

In the preferred embodiment, the force balancing means comprise a generally planar member disposed within the passage means so as to restrict the small amount of air flow therethrough and including a first generally planar surface defining the first axially projected area and a second, opposite, generally planar surface defining the second axially projected area.

Accordingly, it is a primary object of the present invention to provide force balancing means for a systempowered air valve of the type under consideration in order to counteract the axial force or imbalance created by the small amount of air flow which is permitted between the axially extending porition of the valve member and the inner periphery of the sleeve, when the valve member is in a position intermediate its first and second positions.

A further object of the present invention is the provision of force balancing means as aforesaid in such a manner which does not unnecessarily complicate the valve assembly or result in a substantial increase in its cost of manufacture.

These and other objects of the present invention will become apparent hereinafter wherein the best mode for carrying out the invention is disclosed with reference to the appended drawings.

BEST MODE FOR CARRYING OUT THE INVENTION

Figure 1:
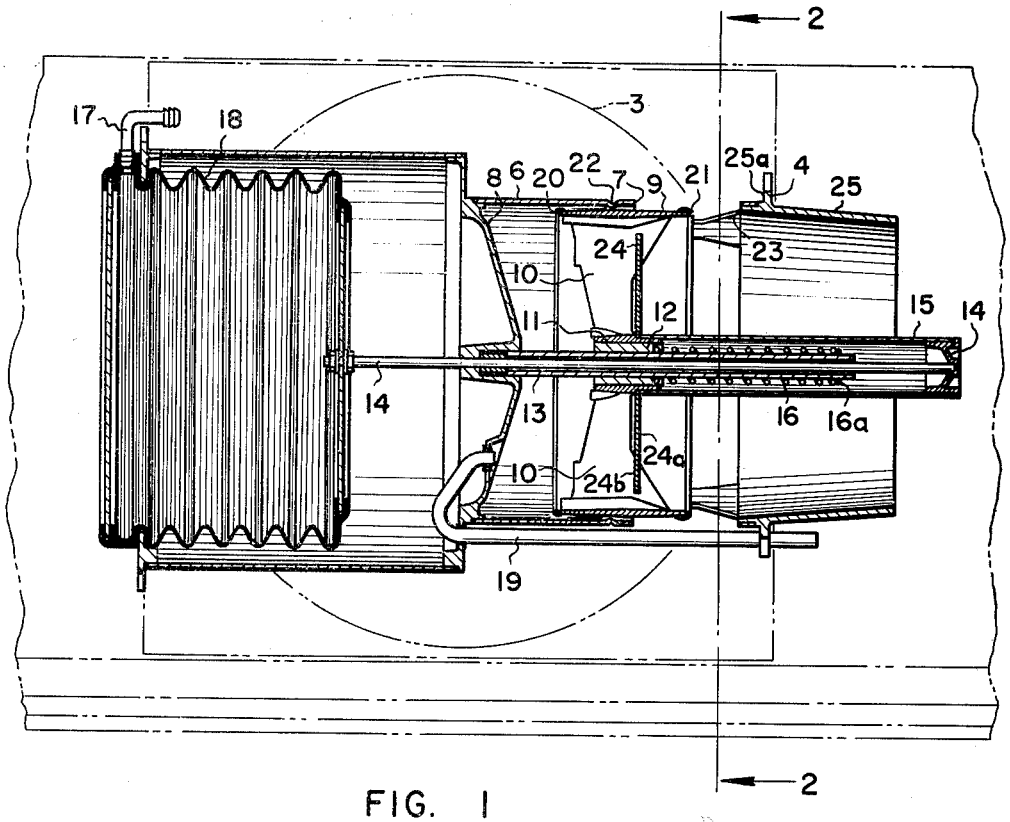
FIG. 1 is a view taken in cross section of the valve assembly comprising the present invention.
Figure 2:
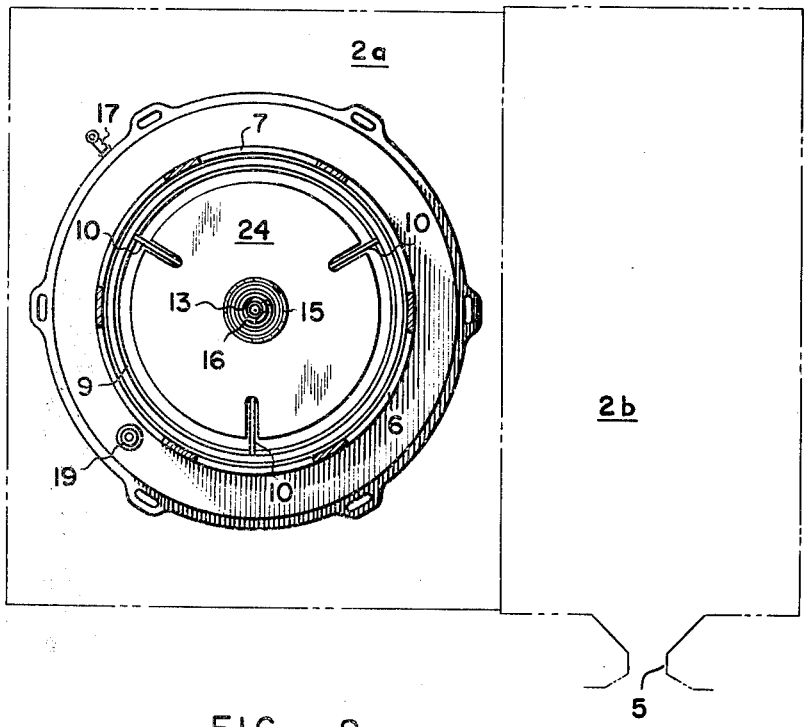
FIG. 2 is a view also taken in cross section along the line 2—2 of FIG. 1.

Turning now to FIGS. 1 and 2 of the drawings, a plenum chamber is illustrated which is formed from two generally rectangular boxes, which may be constructed of suitable sheet metal material, and which define chambers 2*a* and 2*b* which are placed in communication by an opening 3 passing therebetween. An inlet opening 4 communicates with chamber 2*a* and a suitable outlet opening 5 is provided in chamber 2*b*. Reference may be had to the abovementioned U.S. Pat. No. 4,082,114 for a more detailed discussion of suitable plenum configurations for use in valve assemblies of the type under consideration.

As best seen in FIG. 1, conduit means are provided for admitting air to the plenum chamber through inlet opening 4 and include an adapter ring 25 which is constructed so as to be readily connected to a conditioned air duct. Adapter ring 25 also includes a radial flange 25*a* which is provided for fastening the adapter ring to a wall of the plenum chamber 2*a*. The aforesaid conduit means further include a generally cylindrical sleeve 6, at least a portion of which is disposed within the plenum chamber 2*a*, and which includes aperture means 7 passing radially therethrough for providing communication between the interior of the sleeve and the interior of the plenum chamber.

A closure member 8 is disposed at the end portion of sleeve 6 downstream from aperture means 7 so as to block axial air flow.

Disposed within sleeve 6 is a generally cylindrical valve member 9 which includes an axially extending portion disposed adjacent but slightly spaced from the inner pheriphery of sleeve 6. It may be noted at this time that valve member 9 further includes a plurality of web members 10 (see FIGS. 1 and 2) which connect the axially extending portion of the valve member to a centrally located hub 11. As will be appreciated by those skilled in the art, the fact that web members 10 define passage means which permit communication between the axial ends of the valve member means that the valve member is thereby substantially balanced with respect to axial pressure forces to which it is subjected.

Mounting means are provided for supporting valve member 9 for axial movement between a first, closed position substantially coextensive with aperture means 7, thereby blocking flow therethrough; and a second, open position substantially non-coextensive therewith for permitting flow therethrough. As illustrated in FIG. 1, valve member 9 is in a position intermediate the aforesaid first and second positions. The mounting means illustrated in the present invention are substantially similar to that disclosed in the above-referenced U.S. Pat. No. 4,082,114 and include a bearing member 12 disposed within hub 11 of valve member 9, which bearing member rides on tubular means 13 which are supported by closure member 8 and extend axially into sleeve 6.

Also as shown in the referenced patent, actuator means are drivingly connected to the valve member for selectively positioning same between said first and second positions, which actuator means include a rod 14 which passes through a bore in closure member 8, through tubular means 13, terminating in an end cap 14. End cap 14 is associated with a sheath 15 which is connected to hub 11 of valve member 9. Thus, rod 14 may be suitably actuated in order to provide the desired movement and positioning of valve member 9. A coil spring 16 is provided to impose a biasing force upon the valve member, which coil spring is in generally surrounding relationship to tubular means 13 and is restrained at its right end (as seen in FIG. 1) by a suitable spring retainer **16*a***.

Disposed adjacent closure member 8 are diaphragm means generally similar to those disclosed in the referenced U.S. Patent which are operably connected to rod 14 so as to provide a suitable actuating force. Thus, upon admission of a control air pressure signal to fitting 17, the diaphragm 18 will expand or contract in order to impart movement to rod 14. As more fully described in U.S. Pat. No. 4,082,114, the control air pressure signal is to be derived from air pressure present in the air distribution system, the source of which may be suitable fitting such as that shown at 19. As will be appreciated by those skilled in the art, this air pressure source is utilized to supply thermostatic control circuitry in order to arrive at an appropriate control air pressure signal for admission to fitting 17.

Turning now to the gist of applicant's present invention, it should be noted that first sealing means 20 are provided which cooperate with abutment 22 when the valve member is in its first, closed position so as to prevent air leakage thereby. Also when valve member 9 is in its first position, second sealing means 21 cooperate with an abutment 23 so as to prevent leakage.

When valve member 9 is in its second, fully open position, second sealing means 21 cooperate with abutment 22 so as to prevent air leakage.

It is important to note, however, that when valve member 9 is in intermediate positions between said first and second positions, a slight gap exists between first sealing means 20 and the inner periphery of sleeve 6 so as to permit a small amount of air flow between the axially extending portion of valve member 9 and the inner periphery of sleeve 6. This small amount of air flow thus passes through the passage means as defined between web members 10 of the valve member, through the aforesaid gap, and exits via aperture means 7.

Applicant has discovered through testing of valve assemblies of the type under consideration that this small amount of air flow imposes an axial force upon valve member 9 in a direction urging same toward its first, closed position. While this force is of relatively small magnitude, it must be remembered that the actuating force available for a valve assembly of this type, which relies upon system air pressure to provide such force, is limited, more so than if a separate pneumatic air supply or suitable electrical actuating means were employed. For this reason, it has become necessary that means be devised for counteracting this axial force which results in imbalance of the valve member.

Applicant's solution to the problem outlined immediately above lies in the provision of a force balancing disc 24 which, as illustrated, comprises a circular, generally planar member which is connected to hub 11 of valve member 9. The outer diameter of planar member 24 is selected so as to serve as a restriction to the abovereferred-to small amount of air flow, whereby a pressure differential is maintained thereacross, member 24 operating according to the theory of an orifice. Thus, upstream of member 24 exists a relatively high pressure area, while downstream therefrom is established an area of relatively low pressure.

Since planar member 24 includes a first generally planar surface **24*a* which defines a first axially projected area subjected to the relatively high pressure area, and a second, opposite, generally planar surface 24*b* which defines a second axially projected area subjected to the relatively low pressure area, a force is imposed thereon and transferred to valve member 9**, which force is in a direction urging the valve member toward its second, open position to thereby at least partially counteract the above-mentioned axial force.

The outer diameter of planar member 24 may be varied in accordance with the degree to which it is desired to counterbalance the axial force. Thus, in a given application, it may be desirable to counterbalance substantially all of the axial force or, in the alternative, only a portion thereof.

It should be especially noted that the provision of force balancing means as described above in conjunction with a valve assembly of this type does not have an effect upon the generally balanced design of the valve. This is due to the fact that only a very slight pressure differential is permitted to exist on opposite sides of planar member 24 so as to generate the very slight force necessary to counterbalance the axial force produced by the small amount of flow between the inner periphery of sleeve 6 and the axially extending portion of valve member 9. Other than this slight force, no appreciable pressure forces have an effect upon operation of valve member 9.

While the invention has been described with respect to a preferred embodiment, it is to be understood that modifications thereto will be apparent to those skilled in the art within the scope of the invention, as defined in the claims which follow.

I claim:

1. A valve assembly for use in an air distribution system comprising a. a plenum chamber having an inlet opening and an outlet;

b. conduit means for admitting air to said plenum chamber through said inlet opening and including a generally cylindrical sleeve having at least a portion thereof disposed within said plenum chamber, said portion including aperture means passing radially therethrough for providing communication between the interior of said sleeve and the interior of said plenum chamber;

c. a closure member disposed at the end portion of said sleeve downstream from said aperture means for blocking axial air flow;

d. a generally cylindrical valve member disposed within said sleeve and including an axially extending portion disposed adjacent but slightly spaced from the inner pheriphery of said sleeve, said valve member further including passage means extending between its axial ends for providing communication therebetween to thereby substantially balance the axial pressure forces to which it is subjected;

e. mounting means for supporting said valve member for axial movement between a first position substantially coextensive with said aperture means, thereby blocking flow therethrough; and a second position substantially non-coextensive with said aperture means for permitting flow therethrough; and valve member when in positions intermediate said first and second positions permitting a small amount of air flow through said passage means, between the axially extending portion of said valve member and the inner periphery of said sleeve, and through said aperture means; whereby an axial force is imposed upon said valve member in a direction urging same toward said first position;

f. force balancing means connected to said valve member to counteract said axial force, said force balancing means comprising i. a generally planar member disposed within said passage means so as to restrict said small amount of air flow therethrough ,whereby a relatively low pressure area is created downstream of said valve member; and ii. said generally planar member being connected to said valve member and including a first generally planar surface defining a first axially projected area subjected to the relatively high pressure area upstream from said valve member and a second opposite generally planar surface defining a second axially projected area subjected to the relatively low pressure area downstream from said valve member ,whereby a force is imposed on said valve member in a direction urging same toward said second position to thereby at least partially counteract said axial force; and g. actuator means drivingly connected to said valve member for selectively positioning same between said first and second positions.

2. The valve assembly of claim 1 further comprising first sealing means for preventing said small amount of air flow between the axially extending portion of said valve member and the innter periphery of said sleeve when said valve member is in said first position.

3. The valve assembly of claims 1 or 2 further comprising second sealing means for preventing said small amount of air flow between the axially extending portion of said valve member and the inner periphery of said sleeve when said valve member is in said second position.

4. The valve assembly of claim 1 wherein said generally planar member is substantially circular and is disposed at the interior of said generally cylindrical valve member at a point intermediate its axial ends.

5. The valve assembly of claim 1 wherein said valve member includes a centrally located hub having a bore therethrough and a plurality of web members connecting the hub to said axially extending portion and defining therebetween said passage means, said mounting means extending axially through the bore of said hub; and wherein said generally planar member is connected to said hub and disposed in said passage means to thereby restrict said small amount of air flow therethrough.

6. The valve assembly of claim 1 wherein said actuator means include a. diaphragm means disposed adjacent said closure member for receiving a control air pressure signal derived from air pressure present in said air distribution system; and b. means connecting said diaphragm means to said valve member whereby said valve member may be selectively positioned between said first and second positions.

* * * * *

UNITED STATES PATENT AND TRADEMARK OFFICE

CERTIFICATE OF CORRECTION

PATENT NO. : 4,177,970

DATED : December 11, 1979

INVENTOR(S) : Harry K. Ring, Jr.

It is certified that error appears in the above-identified patent and that said Letters Patent are hereby corrected as shown below:

In claim 1, line 30, "and valve member" should read --said valve member--.

Signed and Sealed this

*Twenty-fifth* Day of *March 1980*

[SEAL]

*Attest:*

SIDNEY A. DIAMOND

*Attesting Officer*

*Commissioner of Patents and Trademarks*